US008678955B2

(12) United States Patent
McKendrick et al.

(10) Patent No.: US 8,678,955 B2
(45) Date of Patent: Mar. 25, 2014

(54) METHOD AND APPARATUS FOR SUSPENDING AND SPINNING A SPHERICAL OBJECT

(76) Inventors: Jason S. McKendrick, Aurora, CO (US); Rodney R. Jewkes, Aurora, CO (US)

( * ) Notice: Subject to any disclaimer, the term of this patent is extended or adjusted under 35 U.S.C. 154(b) by 294 days.

(21) Appl. No.: 13/254,700

(22) PCT Filed: Mar. 1, 2010

(86) PCT No.: PCT/US2010/025810

§ 371 (c)(1), (2), (4) Date: Sep. 2, 2011

(87) PCT Pub. No.: WO2010/101847

PCT Pub. Date: Sep. 10, 2010

(65) Prior Publication Data

US 2012/0004054 A1 Jan. 5, 2012

Related U.S. Application Data

(60) Provisional application No. 61/156,788, filed on Mar. 2, 2009.

(51) Int. Cl.
*A63B 69/00* (2006.01)
*A63B 71/00* (2006.01)

(52) U.S. Cl.
USPC ..... 473/418

(58) Field of Classification Search
USPC ..... 473/417, 418, 419, 422, 451, 457, 458; 607/108; D21/720; 124/52, 53, 54, 124/55–59, 6, 60, 61, 62, 73, 81; 248/562, 248/575; 267/131; 359/368, 391, 394; 446/179
See application file for complete search history.

(56) References Cited

U.S. PATENT DOCUMENTS

| | | | | | |
|---|---|---|---|---|---|
| 1,417,523 | A | * | 5/1922 | Howell | 352/85 |
| 1,598,943 | A | * | 9/1926 | Tessier | 248/188 |
| 1,618,773 | A | * | 2/1927 | Meyers | 248/183.3 |
| 1,854,951 | A | * | 4/1932 | Neuwirth | 248/183.2 |
| 1,863,891 | A | * | 6/1932 | Zuber | 352/139 |
| 1,919,554 | A | * | 7/1933 | Howell | 248/183.3 |
| 2,318,633 | A | * | 5/1943 | Ries | 248/183.2 |

(Continued)

FOREIGN PATENT DOCUMENTS

JP 2007259901 A 10/2007

OTHER PUBLICATIONS

PCT Int'l Search Report (ISR) dated Oct. 8, 2010.

*Primary Examiner* — Gene Kim
*Assistant Examiner* — M Chambers
(74) *Attorney, Agent, or Firm* — Matthew J. Lattig; Charter IP, LLC

(57) ABSTRACT

A method and apparatus for suspending and spinning a spherical object includes a blower operably connected to a power source providing a variable airflow of forced air, with an airflow unit coupled to the blower to form a contiguous assembly of the apparatus. The airflow unit may include an integrally formed tubular portion for directing airflow through a nozzle to suspend and spin the spherical object. The assembly is placed in a first angular orientation with respect to vertical for loading the spherical object over the nozzle, and placed in a second angular orientation with respect to vertical different from the first orientation for enabling a user to engage the suspended and spinning spherical object.

22 Claims, 12 Drawing Sheets

(56) References Cited

U.S. PATENT DOCUMENTS

| | | | | | |
|---|---|---|---|---|---|
| 2,935,980 | A | * | 5/1960 | Garver | 124/73 |
| 3,018,769 | A | * | 1/1962 | Parsoneault | 124/75 |
| 3,128,982 | A | * | 4/1964 | Christopher | 248/183.2 |
| 3,288,127 | A | * | 11/1966 | Bullock | 124/73 |
| 3,465,471 | A | * | 9/1969 | Friedman | 446/179 |
| 3,640,263 | A | * | 2/1972 | Rhodes | 124/75 |
| 3,887,182 | A | * | 6/1975 | Breslow | 273/450 |
| 4,207,857 | A | * | 6/1980 | Balka, Jr. | 124/56 |
| 4,575,080 | A | | 3/1986 | Miles | |
| 4,858,921 | A | * | 8/1989 | Eustice et al. | 473/418 |
| 5,257,615 | A | * | 11/1993 | Jones | 124/56 |
| 5,507,271 | A | * | 4/1996 | Actor | 124/56 |
| 5,590,876 | A | | 1/1997 | Sejnowski | |
| 5,676,120 | A | | 10/1997 | Joseph | |
| 5,813,391 | A | * | 9/1998 | Johnson | 124/6 |
| 5,823,894 | A | * | 10/1998 | Actor | 473/422 |
| 5,887,578 | A | * | 3/1999 | Backeris et al. | 124/49 |
| 6,089,217 | A | * | 7/2000 | Paulson et al. | 124/78 |
| 7,156,761 | B2 | | 1/2007 | Mesa | |
| 7,294,071 | B1 | * | 11/2007 | Saumell | 473/451 |
| 7,874,942 | B2 | * | 1/2011 | Auzoux et al. | 473/418 |
| 2008/0009373 | A1 | | 1/2008 | Binder et al. | |
| 2012/0004054 | A1 | * | 1/2012 | McKendrick et al. | 473/418 |

* cited by examiner

METHOD AND APPARATUS FOR SUSPENDING AND SPINNING A SPHERICAL OBJECT

PRIORITY STATEMENT

The present application claims the benefit under 35 U.S.C. §119(e) of U.S. Provisional Patent Application No. 61/156,788 to the inventors, filed Mar. 2, 2009 , the entire contents of which is hereby incorporated by reference herein

BACKGROUND

1. Field

Example embodiments in general are directed to an apparatus and method for suspending and spinning a spherical object.

2. Related Art

Batting tees have developed over the years, beginning with the conventional static tee, where a ball is placed on top of a solid support mounted vertically on a base, and which supports the ball on the upper end of the column. This static tee in effect provides a stationary target for a batter. The column may be adjustable in height and may be flexibly mounted by allowing flexure should it be struck by a miss-aimed bat.

To better simulate the actual rotation of the ball (such as coming out of the pitcher's hand or a batting machine), batting tees have developed to include a system or device in which a fixed nozzle or tubular, hollow, segment attached to some type of blower mechanism in the device exhausts forced air generated by the blower to suspend and rotate the ball in the air when dropped toward the exhausted forced air exiting the nozzle or tubular segment. In one conventional device, a blower within the device moves a column of air through a conduit through a fixed angular or tubular segment attached to a nozzle, exiting the device through the nozzle. If a ball is placed in the exiting moving air column, the ball will be lifted above the level of the end of the segment/nozzle and will remain aloft so long as the air column continues to move. Essentially, the air column provides aerodynamic lift at the upper portion of ball thereby keeping it aloft. The ball remains at a given height supported by a given volume of air moving at a given speed when the amount of lift created by the air column equals the weight of the ball. The device incorporates jets, elbows, plates and end caps to vary the airflow in the conduit. Similar devices utilize rotating and fixed plates to adjust airflow within a conduit or tubular segment.

Another conventional ball suspending apparatus utilizes a dual directional component air stream to support the ball for striking. The dual directional component air stream allows the ball to be spun according to the desire of the operator. For example, a baseball may be supported to simulate the certain spins associated with fastball or curveball pitches thrown by either left or right handed pitchers, thereby allowing the batter to experience the manner in which a certain type of pitch will react when struck with a bat.

This suspending apparatus also utilizes a stream of forced air to support a ball, and is electrically powered to control a blower motor which creates the stream of forced air by which the ball is suspended away from the apparatus. The apparatus utilizes interchangeable fastball simulating and curveball simulating assemblies, each constructed of interconnected, but different segments of fixed plastic tubing.

A person desiring to practice hitting or stroking the ball first chooses the particular simulating assembly for imparting a desired spin and attaches it a reducer member, then connects the ball suspending apparatus to an electrical power source and energizes power thereto. The ball is then placed within the stream of forced air a few inches from an exit port of the selected simulating assembly, where it is held in a fixed position and begins to spin with increasing speed. After some time, the ball eventually reaches a maximum rate of spin, upon which the user takes a position to strike the ball.

In these conventional ball suspending apparatuses, the tubular segments or nozzles through which the forced air exits are set in one fixed place for suspending the ball, or tubular assemblies are switched out for simulating different spins. Furthermore, these devices utilize a combination of jets and plates to vary airflow through the conduit or tubular segment.

SUMMARY

An example embodiment of the present invention is directed to an apparatus for suspending and spinning a spherical object. The apparatus includes a fixed base, a support plate attached to the base and configured to rotate about a vertical axis through the base, an airflow unit pivotally attached to the support plate at one end thereof, the other end terminating in a tubular portion, a motor control unit removably attached to the airflow unit so as to embody a contiguous assembly, where the motor control unit includes means for providing variable airflow to the airflow unit, a rotation arm extending from an upper portion of the motor control unit enabling 360 degree rotation of the contiguous assembly via the support plate about the base, and a plurality of interchangeable nozzles configured for attachment to the tubular portion of the airflow unit to direct the airflow generated by the motor control unit for suspending and spinning the spherical object. The apparatus is configured in a first angular orientation with respect to vertical for loading the spherical object over one of the installed nozzles exhausting air from the airflow unit, and configured in a second angular orientation with respect to vertical different from the first in order for a user to engage the suspended and spinning spherical object.

Another example embodiment is directed to an apparatus for suspending and spinning a spherical object which includes a fixed base, a support plate attached to the base, an airflow unit attached to the support plate at one end thereof, the other end terminating in a tubular portion, a variable-speed motor, a motor controller adapted to provide speed control for the motor so as to provide variable airflow through the airflow unit, and a nozzle attached to the tubular portion of the airflow unit to direct the airflow generated by the motor for suspending and spinning the spherical object. The apparatus is configured in a first angular orientation with respect to vertical for loading the spherical over the nozzle exhausting air from the airflow unit with the nozzle end extending upward in a range of 0 to 10 degrees from vertical, and configured in a second angular orientation with respect to vertical different from the first in order for a user to engage a suspended and spinning spherical object with the nozzle end extending 30 to 50 degrees from vertical.

Another example embodiment is directed to a method for suspending and spinning a spherical object. In the method, a blower operably connected to a power source is provided for creating a variable airflow of forced air. An airflow unit coupled to the blower is provided so that blower and airflow unit form a contiguous assembly. The airflow unit has in integrally formed tubular portion for directing airflow through a nozzle to suspend and spin the spherical object. The assembly is placed in a first angular orientation with respect to vertical for loading the spherical object over the nozzle, and placed in a second angular orientation with respect to vertical different from the first orientation for enabling a user to engage the suspended and spinning spherical object.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

Figure 1:
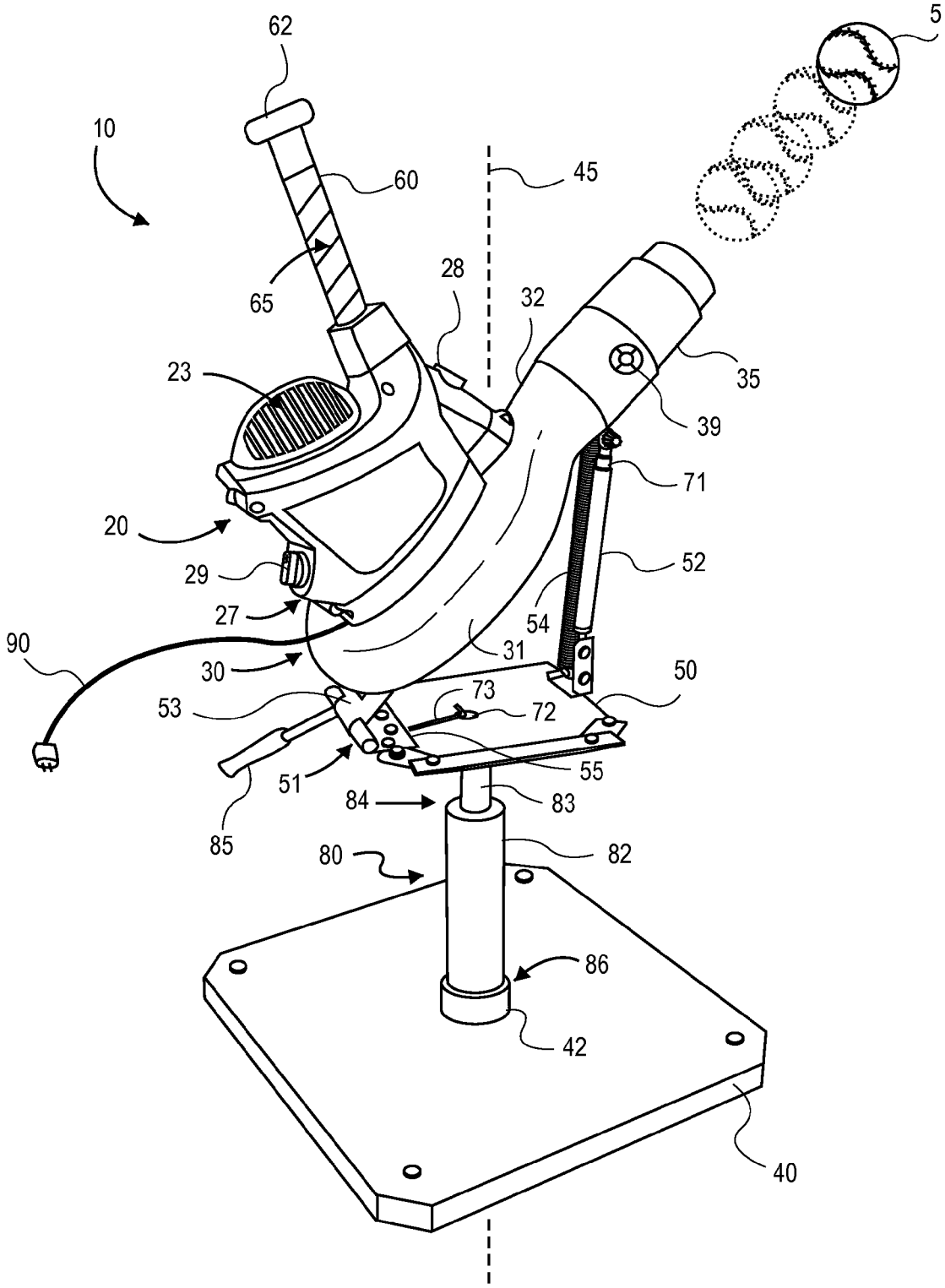
FIG. 1 is a perspective view of an apparatus for suspending and spinning a spherical object in accordance with an example embodiment.

FIG. 1 is a perspective view of an apparatus for suspending and spinning a spherical object in accordance with an example embodiment. Referring to FIG. 1, there is shown an apparatus 10 for suspending and spinning a spherical object 5, shown in this example as a baseball. Apparatus 10 includes a motor control unit 20 coupled to an airflow control unit 30 so as to form a contiguous assembly that is pivotally supported on a support plate 50 by a hinge 51. As to be described in more detail below, the motor control unit 20 includes means for providing variable airflow to the airflow unit 30. The total system weight of apparatus 10 may be between approximately 10-12 pounds and between about 7-9 pounds for components above the motor control unit 20.

A rotation arm 60 from an upper portion of the motor control unit 20. The rotation arm 60 permits 360 degree rotation of the apparatus 10 around a vertical axis 45 bisecting a base 40 of the apparatus 10. The base is attached to the support plate 50 via a strut 80. The rotation arm 60 also provides a means to pick up and carry or transport the apparatus 10, and includes an optional decorative end cap 62 and an over-molded, non-slip grip 65. Grip 65 may be made of a suitable elastomeric material such as rubber, or be composed of a woven fabric material for example.

Figure 12:
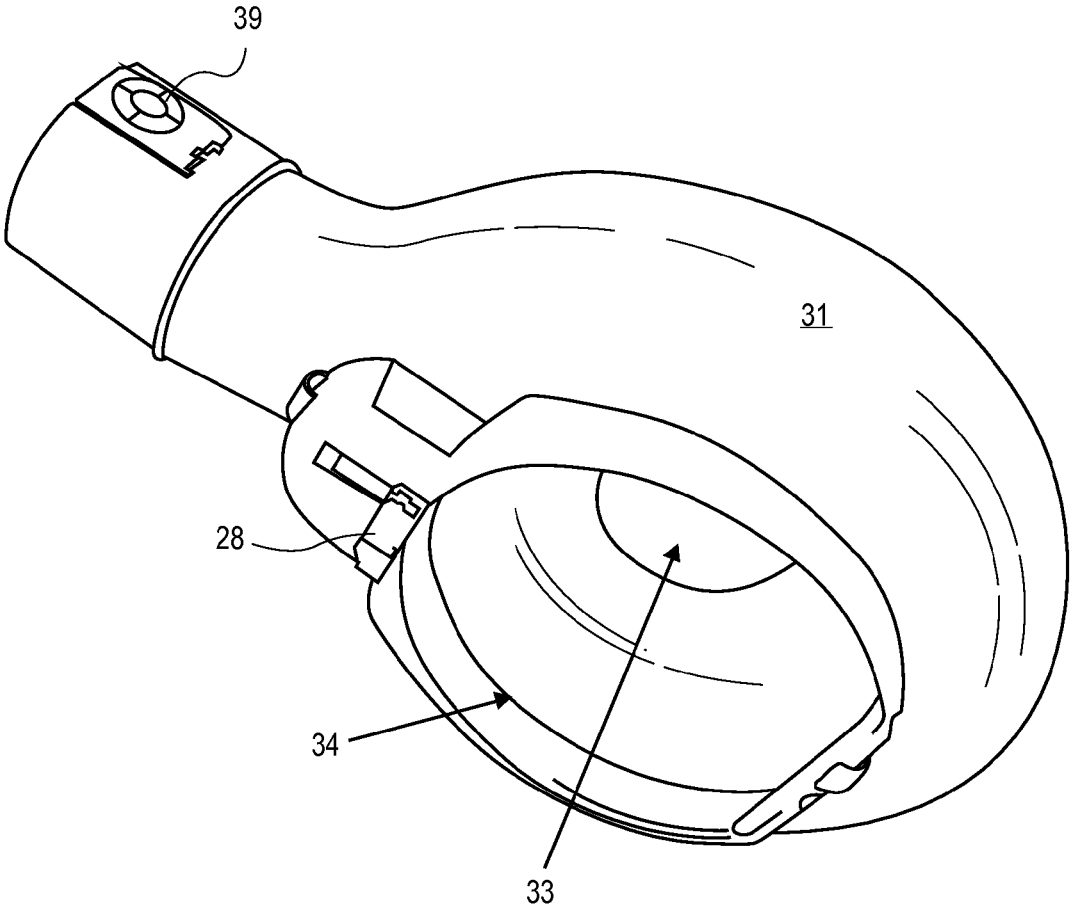
FIG. 12 is a partial cutaway view of the airflow unit to show elements in further detail.

FIG. 12 is a partial cutaway view of the airflow unit to show elements in further detail. Airflow unit 30 includes a generally hollow housing 31 which terminates at one end thereof as tubular portion 32. The tubular portion 32 is configured to receive one of a plurality of interchangeable and hence removable nozzles 35. The nozzle 35 is designed to direct the airflow generated by the motor control unit 20 for suspending and spinning the spherical object 5. The tubular portion 32 further includes a pair of bosses 39 thereon which are configured to engage circular catches 350 formed in the nozzle 35 for press-fit engagement.

Housing 31 includes a first opening 33 formed in an upper portion thereof to permit airflow there through that is generated by the fan motor 25, via the rotating blades 26, in the motor control unit 20, which in turn is directed to the tubular portion 32. Housing 31 includes a second opening 34 formed in a lower portion thereof, with the air intake screen 36 (not shown) enclosing the second opening 34.

In general, the motor housing 21, airflow unit housing 31, inclusive of tubular portion 32, and the nozzle 35, can be formed by an injection molding process from a medium or heavy gauge impact plastic such as acrylonitrile butadiene styrene (ABS). ABS is an easily machined, tough, low-cost, rigid thermoplastic material with medium to high impact strength, and is a desirable material for turning, drilling, sawing, die-cutting, shearing, etc.

ABS is merely one example material; equivalent materials include various thermoplastic and thermoset materials having characteristics similar to ABS. For example, polypropylene, high-strength polycarbonates such as GE Lexan®, and/or blended plastics may be used instead of, or in addition with ABS. The materials comprising the motor housing 21, airflow unit housing 31, tubular portion 32, and nozzle 35 (plastics such as ABS, rubber and lightweight metal materials) provide a light yet durable construction.

An exemplary injection molding system for forming molded plastic articles included in apparatus 100 may be the Roboshot® injection machine from Milacron-Fanuc. The Roboshot is one of many known injection molding machines for forming plastic injection molds. Although apparatus 10 is shown composed of several individual molded components fit together, the outer housing of apparatus 10 could be a single injection-molded article which houses a fan motor 25 (not shown) and a variable speed motor controller 27 therein, for example.

Referring to FIG. 1, an external AC power source provides electrical power to the motor control unit 20 via power cord 90. The motor controller 27 is connectable to the AC power source (AC Mains) via the power cord 90 and to the motor armature and field of the fan motor 25, as is known. Motor controller 27 includes a variable speed dial wheel or control knob 29 operable by the user in order to set and/or change to the desired motor speed.

Figure 2:
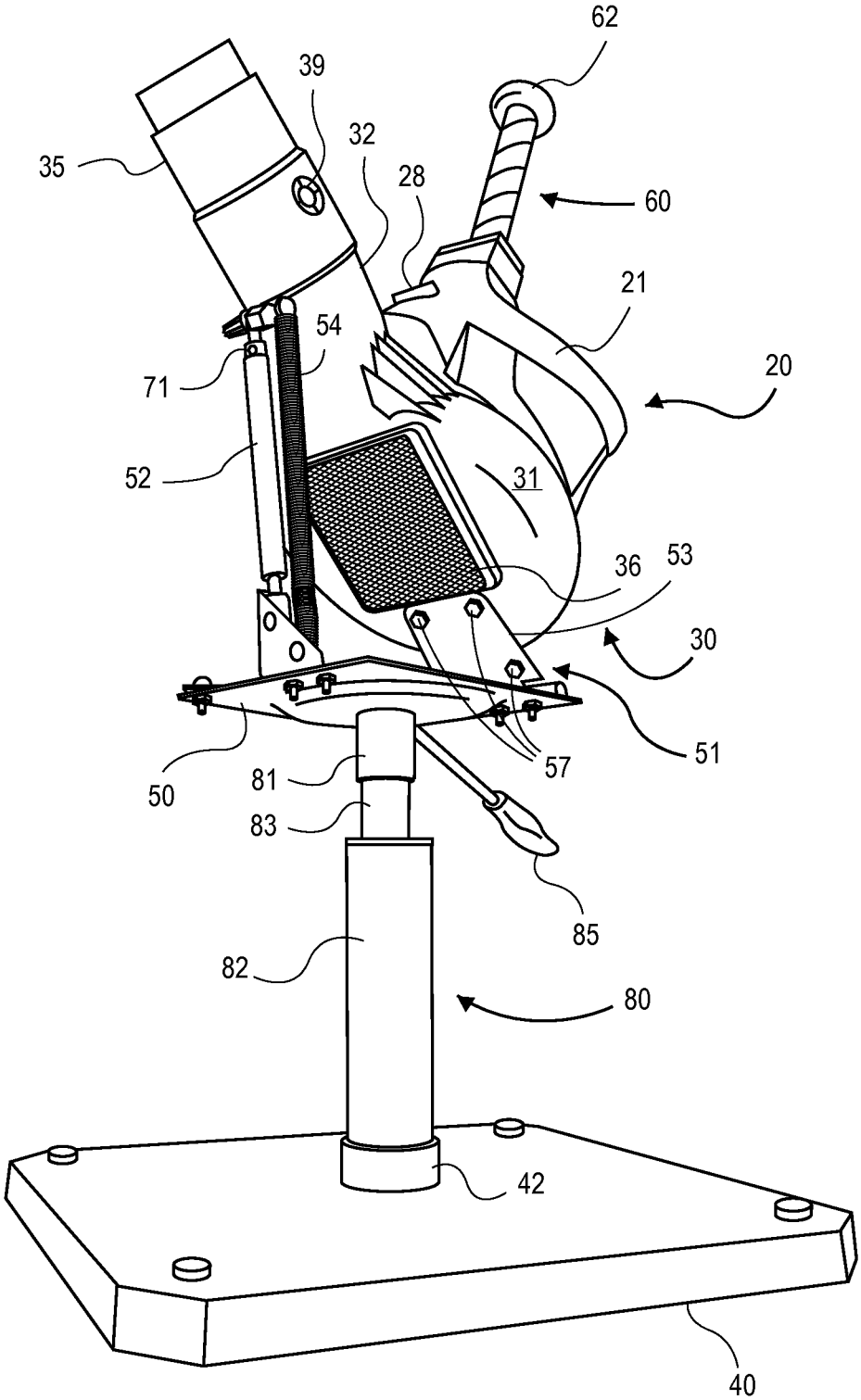
FIG. 2 is a different perspective view of the apparatus of FIG. 1.

FIG. 2 is a different perspective view of the apparatus of FIG. 1. FIG. 2 is provided to show additional details of support plate 50. The airflow unit 30 may be pivotally attached to the support plate 50 at one end thereof by hinge 51. Hinge 51 includes a first bracket part 53 attached to an underside rear end of the airflow unit 30, and a second bracket part 55 attached to a top surface of the support plate 50 on an edge thereof. A plurality of fasteners 57 attaches the bracket parts 53, 55 as shown. A piston 52 and a torsion spring 54 are connected between an underside point 38 of the tubular portion 32 and a top surface of the support plate 50 on a side 58 opposite the hinge 51, in side-by-side relation to facilitate movement of the contiguous assembly (motor control unit 20, airflow unit 30) in a controlled manner back and forth between the first and second angular orientations.

The piston 52 includes an adjustable stop 71. The stop 71 is designed to be set so as to limit travel of the piston 52. The support plate 50 further includes a magnet 72 located centrally thereon. The magnet 72 retains a removable wrench 73, such as an Allen wrench. Wrench 73 may be used to adjust and tighten the stop 71 in the desired location on the piston 52. FIG. 2 further illustrates the air intake screen 36 which covers the second or lower opening 34 in the housing 31 of the airflow unit 30.

A sleeve 81 is provided at an underside of the support plate 50. The sleeve 81 may be integrally formed as part of the support plate 50 or welded thereto. The sleeve 81 is designed to be friction fit to a strut 80 so as to be removable from strut 80. Strut 80 represents a height adjustment means for apparatus 10. The upper end 84 of strut 80 is tension fit into the hollow bore of sleeve 81, and the lower end 86 is seated into a base holder 42 on the base 40. A lever 85 is provided for actuating the strut 80 to adjust height of the support plate 50, so as to raise or lower the assembly thereon. Accordingly, the sleeve 81 is friction fit over the strut upper end 84 so as to allow variable height adjustment of the apparatus 10.

Figure 3:
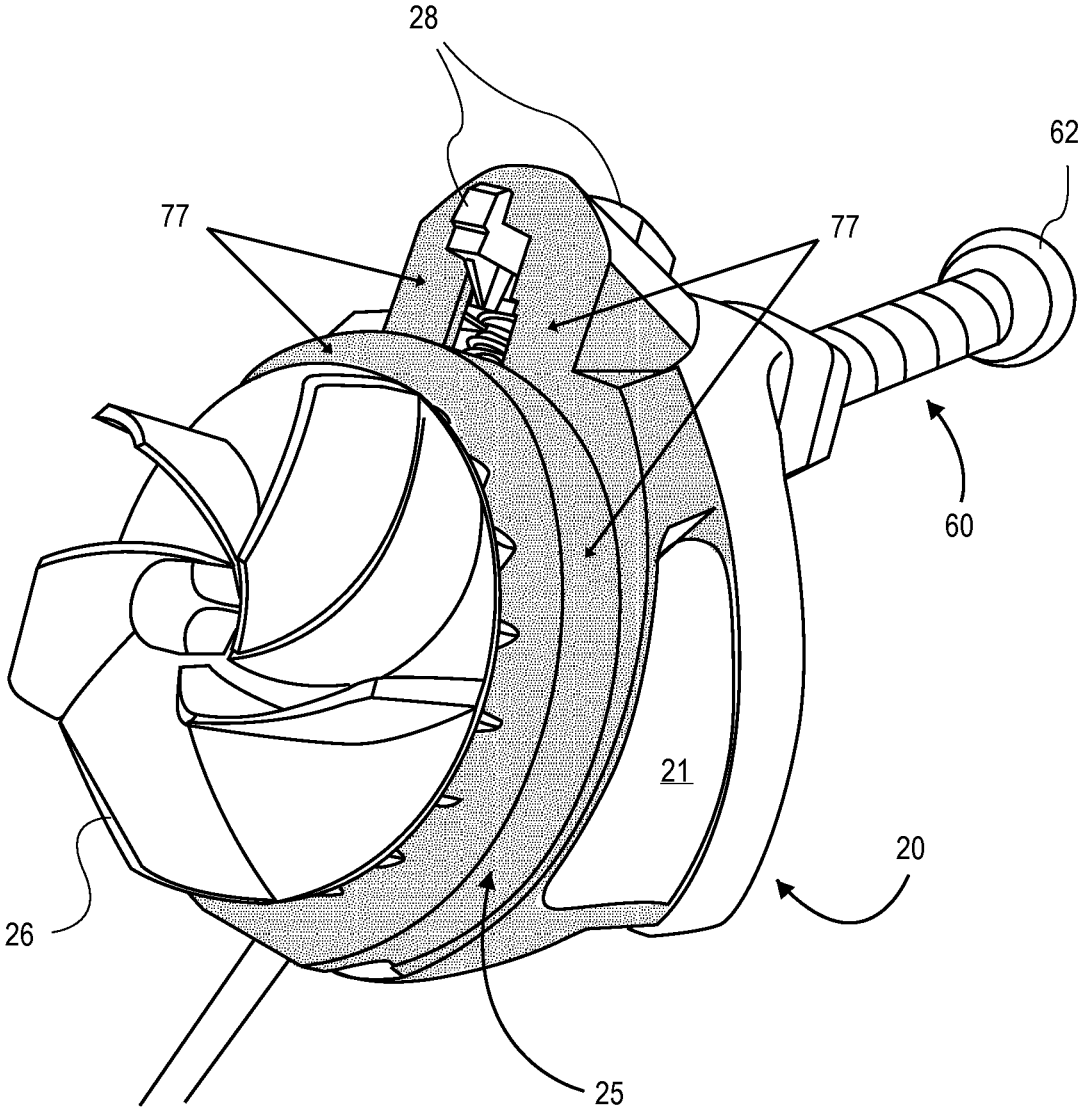
FIG. 3 is a bottom perspective view of the motor control unit.

FIG. 3 is a bottom perspective view of the motor control unit. The motor control unit 20 includes a generally hollow motor housing 21. The motor housing 21 includes a plurality of vents 23 on an upper surface thereof for exhausting heat generated by the fan motor 25 therein. A latch/release mechanism 28 enables the motor control unit 20 to be removably coupled to the upper portion of the airflow unit 30 so that motor housing 21 matingly engages the airflow unit housing 31.

In addition to the fan motor controller 27, the motor control unit 20 includes blower means for generating forced airflow; namely the electric fan motor 25. Fan motor 25 powers a plurality of blades 26 to provide variable airflow under control of the fan motor controller 27 so as to rotate the blades 26 to generate air flow into the airflow unit 30.

The fan motor 25 may be embodied as a multi-speed universal motor and the controller 27 is a variable speed motor controller. In one example, fan motor 25 may be an ES (open frame) universal motor such as is manufactured by MAMCO®; a continuous duty, 2-speed motor, rated between 115 to 240 VAC, 50/60 Hz, up to 1-1½ HP at up to 15,000 RPM. In another example, the fan motor 25 may be a variable-speed AC or DC motor, controllable by the variable speed motor controller 27. Apparatus 10 may be configured to provide a maximum air speed of up to at least 240 mph.

FIG. 3 additionally illustrates the incorporation of soundproofing in apparatus 10. Specifically, interior surfaces of the motor control unit 20 and airflow unit 30 may be covered or applied with sound dampening material 77 to counteract the noise emitted by the fan motor 25. The material 77 may be applied in the form of a spray, paint/coating or adhesive/glue, for example.

Figure 4:
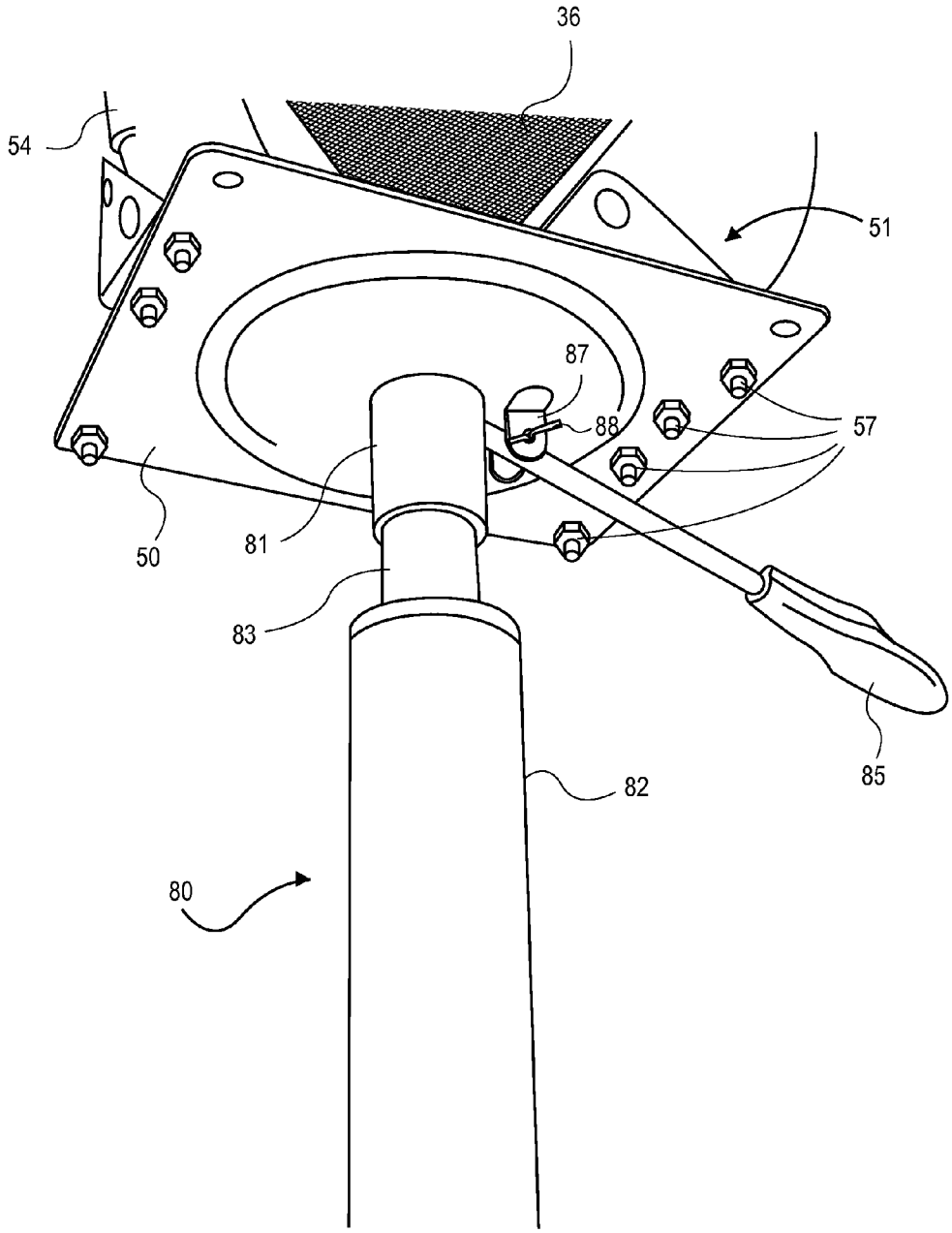
FIG. 4 further illustrates the connection of the lever to the strut upper end.

FIG. 4 further illustrates the connection of the lever 85 to the strut upper end 84. Sleeve 81 includes a slotted aperture (not shown) permitting access of the lever to engage the piston 83 therein. The lever is attached to the underside of support plate 50 via bracket 87, whereby a cotter pin 88 engages a pin (no shown) extending through bracket 87 and lever 85.

Figures 5A, 5B, 5C, 5D:
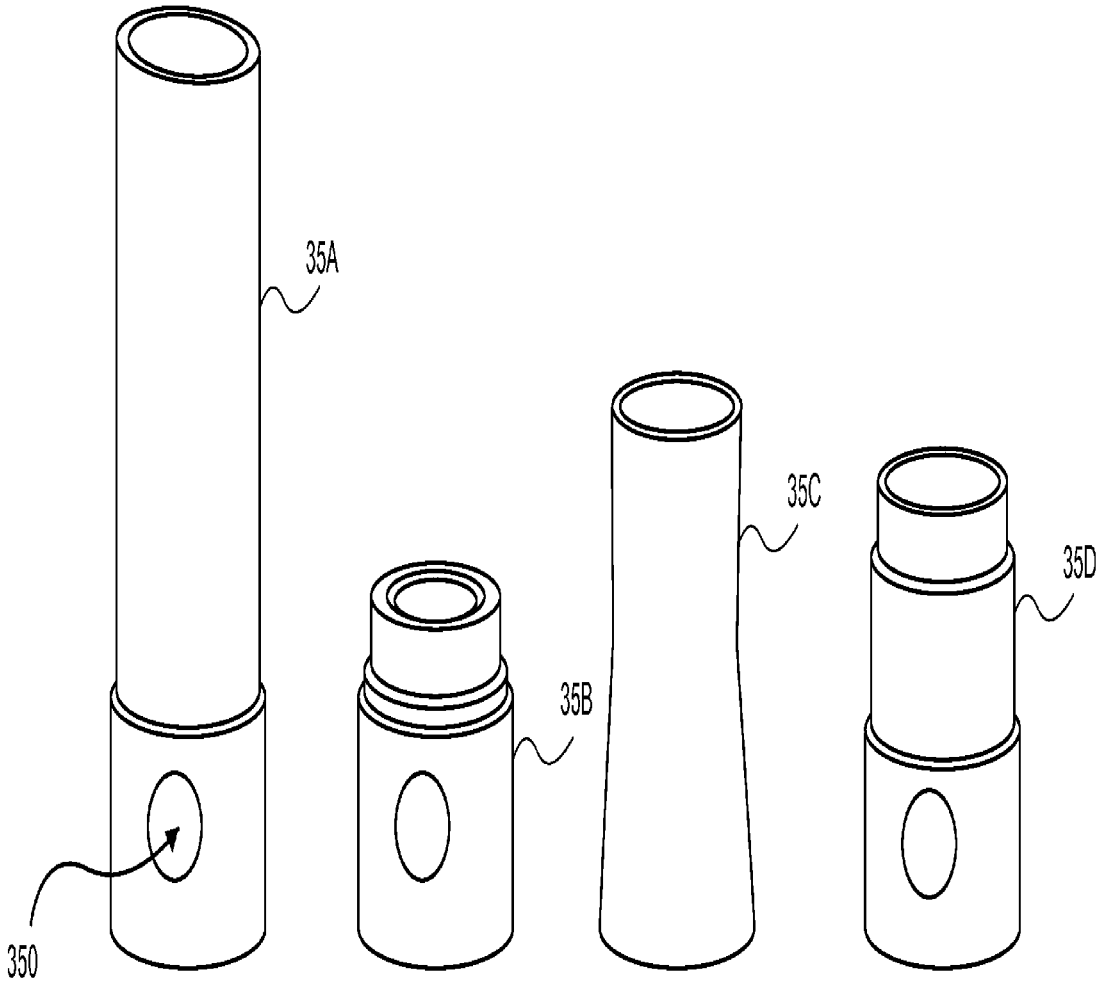
FIG. 5 illustrates various sized nozzles configured for attachment to the tubular portion of the airflow unit in any of FIGS. 1, 6, 9 and 11.

FIG. 5 illustrates various sized nozzles configured for attachment to the tubular portion of the airflow unit in any of FIGS. 1, 6, 9 and 11. Each of nozzles 35A, 35B and 35D may be made of a medium-hard plastic such as ABS and are of different lengths and profiles to provide slightly different action on the object 5. As shown, each includes a pair circular catches 350 on opposing sides thereof that are adapted to engage the bosses 39 on the tubular portion 32 so as to secure the respective nozzle thereon. Nozzle 35C is embodied as an elastomeric sleeve structure to friction fit over the tubular portion 32 on airflow unit 30.

The softer, more flexible nozzle 35C may be desirable for instruction and/or learning purposes, as it can be inadvertently struck without damaging the nozzle. The more rigid nozzles 35A, 35B and 35D are designed for more competitive training, performance, etc.

Figure 6:
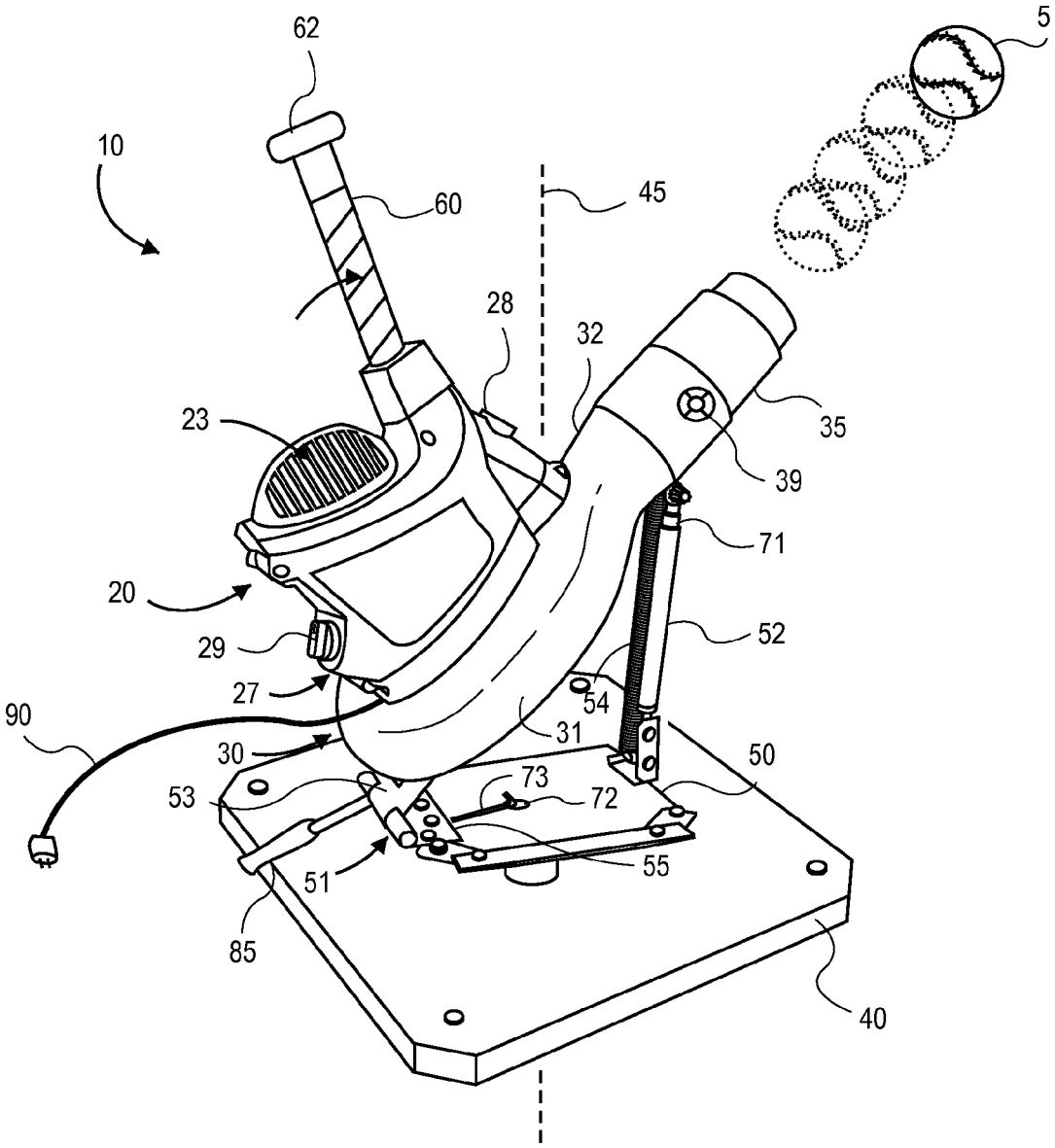
FIG. 6 is a perspective view of the apparatus of FIG. 1 without the strut.

FIG. 6 is a perspective view of the apparatus of FIG. 1 without the strut. In FIG. 6, the apparatus 10 sits directly on base 40. Here, strut 80 has been removed such that sleeve 81 friction fits directly into base holder 42. This embodiment permits smaller, shorter children or wheelchair-bound individuals to be able to participate in engaging the spherical object 5.

Figure 7:
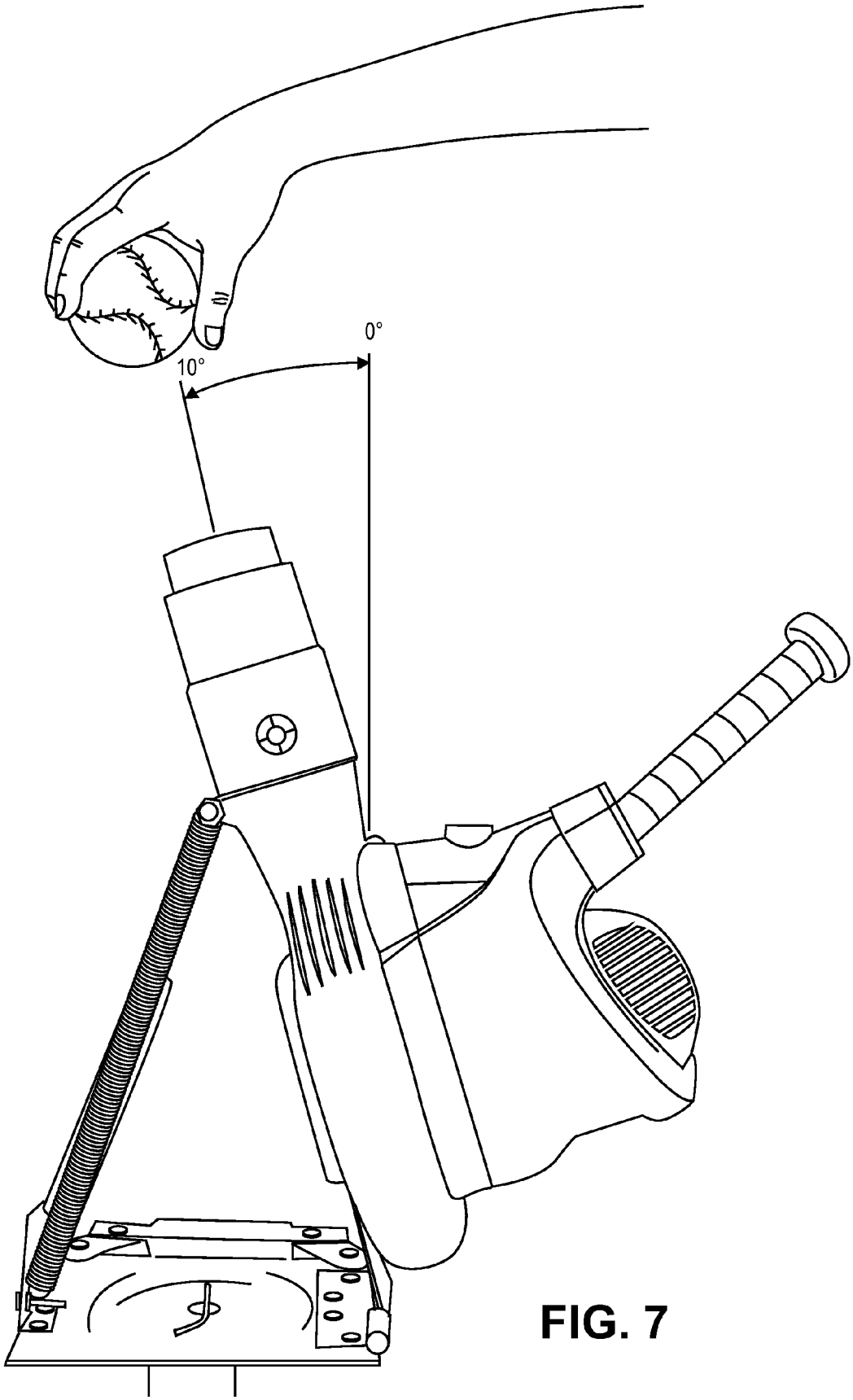
FIG. 7 is a side elevational view of the apparatus of FIG. 1 to illustrate the loading position thereof for the spherical object.
Figure 8:
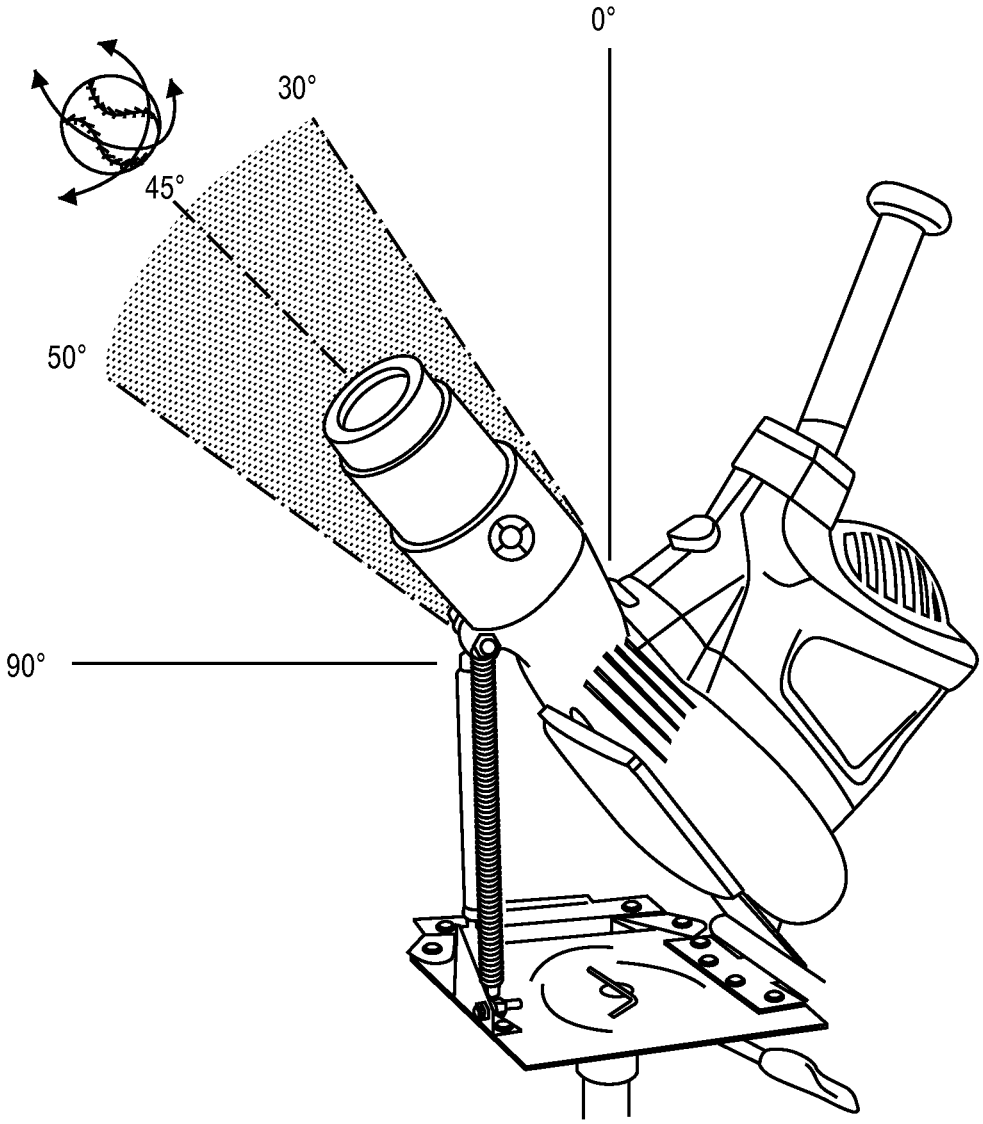
FIG. 8 is a side elevational view of the apparatus of FIG. 1 to illustrate the engagement position thereof for user interaction with the spherical object.

FIG. 7 is a side elevational view of the apparatus of FIG. 1 to illustrate the loading position thereof for the spherical object; and FIG. 8 is a side elevational view of the apparatus of FIG. 1 to illustrate the engagement position thereof for user interaction with the spherical object.

As best shown in FIG. 7, the apparatus 10 is in a first angular orientation with respect to vertical for loading the spherical object 5 over one of the installed nozzles 35 exhausting air from the airflow unit 30. In an example, the apparatus 10 is in the first angular orientation with respect to vertical for loading as the nozzle 35 end extends upward in a range of between 0 to 10 degrees from vertical.

As best shown in FIG. 8, the apparatus 10 is in a second angular orientation with respect to vertical different from the first in order for a user to engage the suspended and spinning spherical object 5. In an example, the apparatus 10 is in the second angular orientation with respect to vertical for engaging the suspended and spinning spherical object 5 as the nozzle 35 end extends in a range of between 30 to 50 degrees from vertical. In another example, the second angular orientation for engaging the spherical object 5 is achieved with the nozzle end extending 45 degrees from vertical. Testing has shown that this angular position from vertical has proven optimum for engagement with object 5; i.e., the object 5 remains in a suspended state with rotation at a given distance from the end of the nozzle 35 for an almost unlimited duration, until cessation of forced air.

Accordingly, the forced column of air exhausted from the airflow unit 30 through the tubular portion 32 (acting as a reducer with nozzle 35) shapes the air column to suspend and support spherical object 5 by commonly understood laws of aerodynamics. The column of air and spherical object 5 work against each other as gravity attempts to ground the spherical object 5.

For example, as the nozzle with exhausting air column is rotated from the first angular position (loading position) in a controlled manner to the second angular position (engage position), thus engaging the piston 52 and torsion spring 54, the unbalanced forces become in balance with the spherical object 5. The spherical object 5 distances itself from the end of the nozzle 35 and rotates about its center of gravity on the boundary layer between the fast-moving column of air and the surrounding environment. Off-axis reactive forces resulting from the object 5's interaction with the boundary layer cause the object 5 to begin spinning about its center of gravity.

Heretofore the spherical object 5 has been shown and described as a baseball 5. It is evident that apparatus 10 may be adapted to spin and suspend any type and/or size of spherical object, limited on by the ratings of the fan motor 25. Additional examples include but are not limited to a softball, wiffle ball, tennis ball, volleyball, soccer ball, basketball, and golf ball.

Accordingly, in an operation to suspend and spin the spherical object 5, such as a baseball for batting practice as one example, the motor control unit 20 is operably connected to the power source via cord 90 and the apparatus 10 is energized in order to generate the variable airflow of forced air. Air through air intake screen 36 is rotated in the fan blades 26 and directed back through the airflow unit housing 31 into the tubular portion 32, whereupon it is directed out through the nozzle 35 end to exit apparatus 10. A user grasps rotation arm 60 so as to place apparatus 10 in the loading position as shown in FIG. 7; i.e., the first angular orientation with respect to vertical for loading the spherical object 5 over the nozzle 35. Via rotation arm 60, the apparatus 10 is then placed in the engage position as shown in FIG. 8; i.e., the second angular orientation with respect to vertical. This permits a person (in this example the batter) to engage the suspended and spinning spherical object 5.

In an example, apparatus 10 permits the user to direct the spherical object 5 through an unobstructed zone or area for striking or engaging the object 5 at any given desired time, or at the desired time of the user. The apparatus 10 suspends object 5 for the user's desired length of time; the object 5's distance from the nozzle 35 may be manipulated by using the fan speed control dial 29. This feature allows the user and/or coach to utilize specific training techniques that simulate game situations.

The unobstructed zone or area for striking or engaging the spherical object 5 when apparatus 10 is in the engaged or engaging position provides optimum impact for the object or implement being used to engage or strike object 5. Once apparatus 10 has been re-positioned from the loading position to the engaging position, the user or coach can place the suspended object 5 for an infinite period of time within the engaging or "striking zone", simply by rotating/panning the apparatus about a 360 degree horizontal plane using the rotation arm 60 so as to emulate the "soft toss" drill, for example, while being able to concentrate or give instruction on the perfect striking path to the object 5. Another example activity would be for a volleyball player to position apparatus 10 near the net, so as to suspend the volleyball in the engaging position to emulate the desired zone at which it may be set for striking.

The example apparatus 10 further enables a user to engage different sized spheres or balls in the same training session to improve the user's hand/foot eye coordination. This provides the user the ability to engage the suspended sphere in a consistent position multiple times during a short time frame, facilitating or improving muscle memory. The user may experience full 360 degree coverage of the engaging and/or striking zone on balls/spheres that are placed and suspended up, down, inside, outside and middle of this zone by simply positioning apparatus 10 for desired simulation.

Figure 9:
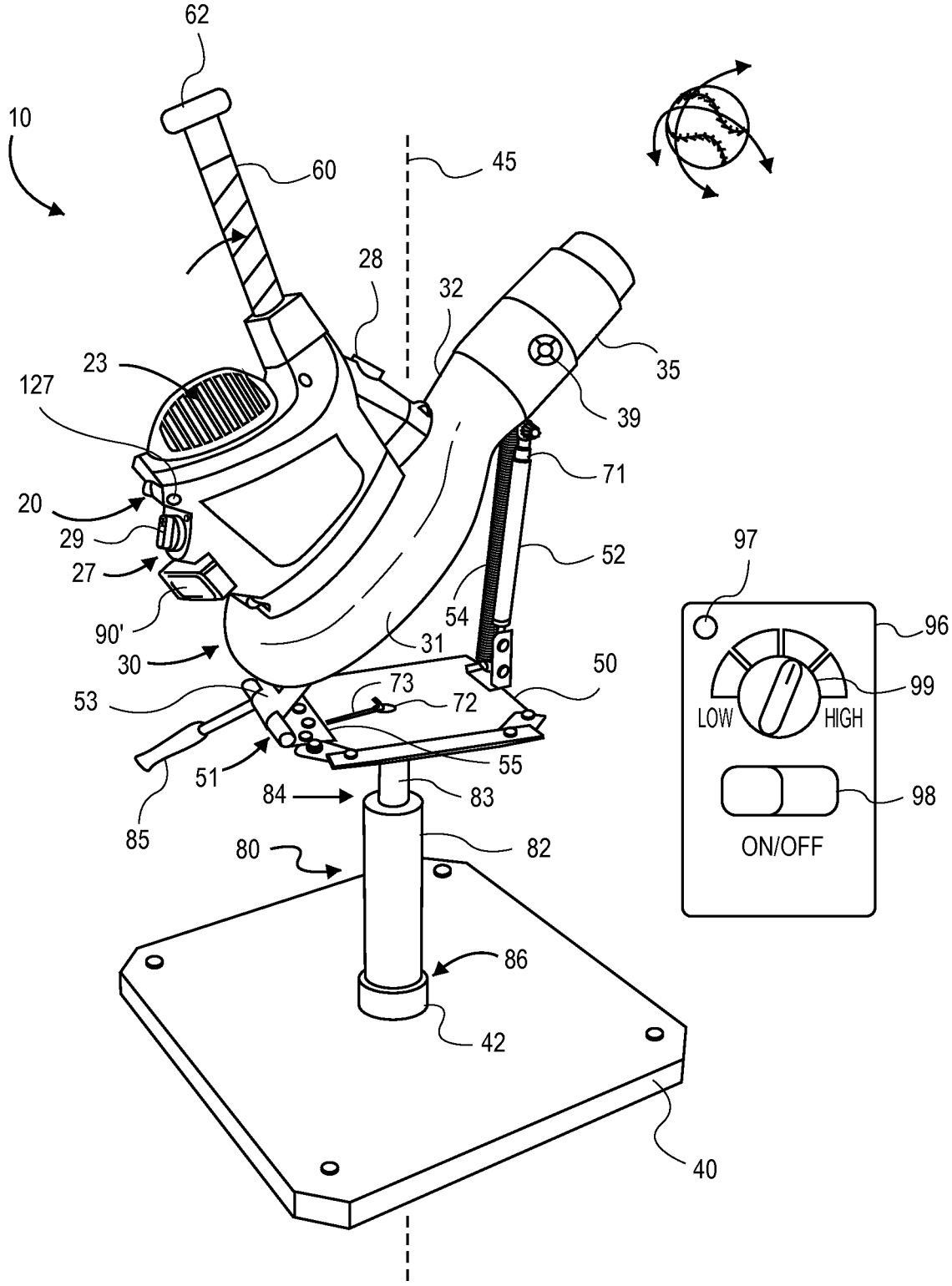
FIG. 9 is a perspective view of an apparatus for suspending and spinning a spherical object in accordance with another example embodiment.

FIG. 9 is a perspective view of an apparatus for suspending and spinning a spherical object in accordance with another example embodiment. Instead of power source being embodied as AC line power (shown by cord 90), the motor may be configured as a brushless DC motor and can be powered by a batter pack 90', thereby providing a cordless apparatus 10. In one example, the battery pack 90' may include a housing with one or more disposable cells having alkaline or lead-acid cell chemistry therein.

In another example, battery pack 90' may be a rechargeable high power battery pack having one or a plurality of cells. For example, the cells in battery pack 90' may be embodied as having one or more of a lithium metal oxide cell chemistry, a lithium-ion phosphate (LPF) cell chemistry and/or another lithium-based chemistry makeup, for example, in terms of the active components in the positive electrode (cathode) material.

As examples, the active material in the cathode of a cell with metal oxide chemistry may be one of lithiated cobalt oxide, lithiated nickel oxide, lithiated manganese oxide spinel, and mixtures of the same or other lithiated metal oxides. The active component in the cathode of a cell having LPF chemistry is lithiated metal phosphate, as another example. These cells may be cylindrically shaped and have a spiral wound or "jelly roll" construction as to the cathode, separators and anode, as is known in the battery cell art. The material of the negative electrode may be a graphitic carbon material on a copper collector or other known anode material, as is known in the Li-ion battery cell art. In other examples, battery pack 90' may include one or more rechargeable cells having a nickel-cadmium (NiCd) or nickel-metal-hydride (NIMH) cell chemistry.

For cordless apparatus 10, the fan controller 27 may be configured to include smart electronics and transceiver circuitry so as to communicate wirelessly with a remote control unit 96. For example, controller 27 may include a microcontroller therein. Microcontroller may include program ROM (alterable ROM) such as flash memory, a CPU core such as a microprocessor, on-board peripherals, and non-volatile memory such as RAM or SRAM on a single chip construction, for example. The non-volatile memory may be adapted to retain stored information even when not powered. Examples of non-volatile memory include RAM (DRAM, SRAM, SDRAM, VRAM, etc.), magnetic and optical-based memory. Types of alterable solid-state ROM may include Erasable Programmable Read-Only Memory (EPROM) and Electrically Erasable Programmable Read-Only Memory (EEPROM). EPROM can be erased by exposure to ultraviolet light then rewritten via an EPROM programmer, and is identifiable by a circular 'window' in the top which allows the UV light to enter. EEPROM such as Flash memory allows the entire ROM (or selected banks of the ROM) to be electrically erased (flashed back to zero) then written to without taking the banks out of the computing device.

In an example, the microcontroller may be one of the ATMEL AVR® 8-bit RISC microcontrollers, such as the ATmega8 flash microcontroller with 8-Kbyte self-programming Flash Program Memory (EEPROM). However, the controller 27's intelligent control is not limited to the example microcontroller. The intelligent control device could be embodied in hardware and/or software as another microprocessor, an analog circuit, a digital signal processor, etc., or by one or more digital ICs such as application specific integrated circuits (ASICs), for example.

The remote control unit 96 may also include associated smart electronics such as a microcontroller or microprocessor, and includes an on/off switch 98 and speed control knob 99. Each of the fan controller 27 and remote control unit include transceiver circuitry enabling wireless communication there between. In one example, a visual indicator, generally represented by element 97 on remote control unit 95 and element 127 on motor control housing 21, when lit, may represent that the apparatus 10 and remote control unit 95 are configured for wireless communication, although no visual indicator is necessary for communication between the transceivers.

In operation, based on a signal received from the speed control knob 99, the controller utilizes its transceiver to communicate with the fan controller 27 via radio frequency (RF) signals sent thereby, which are received by the transceiver at the fan controller 27. As an alternative to RF transmission, communication may be via infrared, sound or other equivalent wireless communication means, for example.

Figure 10A:
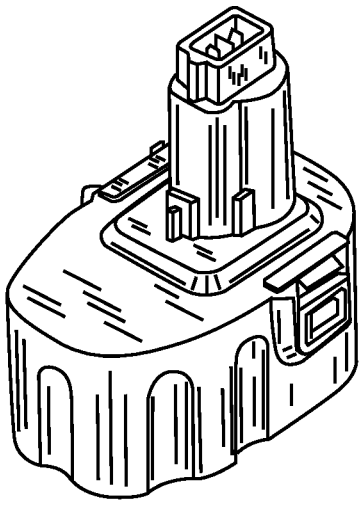
FIGS. 10A-10C illustrates example battery pack configurations for the apparatus in accordance with a cordless embodiment.
Figure 10B:
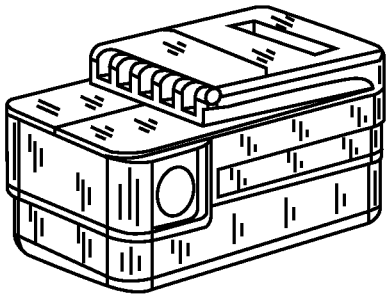
Figure 10C:
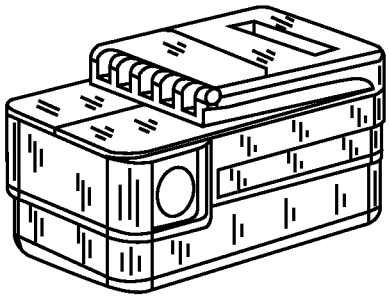

FIGS. 10A-10C illustrates example battery pack configurations for the apparatus in accordance with the cordless embodiment. These figures illustrate well-known tower-style and rail-style terminal configurations of rechargeable battery packs commonly used in many power tool applications, in which the pack terminals are configured for connection to corresponding terminals in the motor control unit and/or a battery charger. As such, a detailed explanation of these connective arrangements and the operation thereof is omitted for purposes of brevity.

FIG. 10A shows a conventional 18V NiCd battery pack with a tower-style terminal setup. FIG. 10B illustrates the profile for an example 36V Li-ion pack with rail-style terminal arrangement that is consistent with the dimensions of the conventional 18V NiCd pack of FIG. 10A. FIG. 10C illustrates the dimensions of an example 25V Li-ion pack with rail-style terminal arrangement that is consistent with the dimensions of the conventional 18V NiCd pack of FIG. 10A. Although the battery packs of FIGS. 10B and 10C are shown as having an approximate nominal voltage of 36V and 25.2V respectively, the constructions and/or dimensions could apply to differently rated Li-ion battery packs, for example. The nominal voltage of the battery pack 90' is at least about 18V. In another example, the battery pack 90' as shown in any of FIGS. 10A-10C can provide a nominal voltage of approximately 28V.

Figure 11:
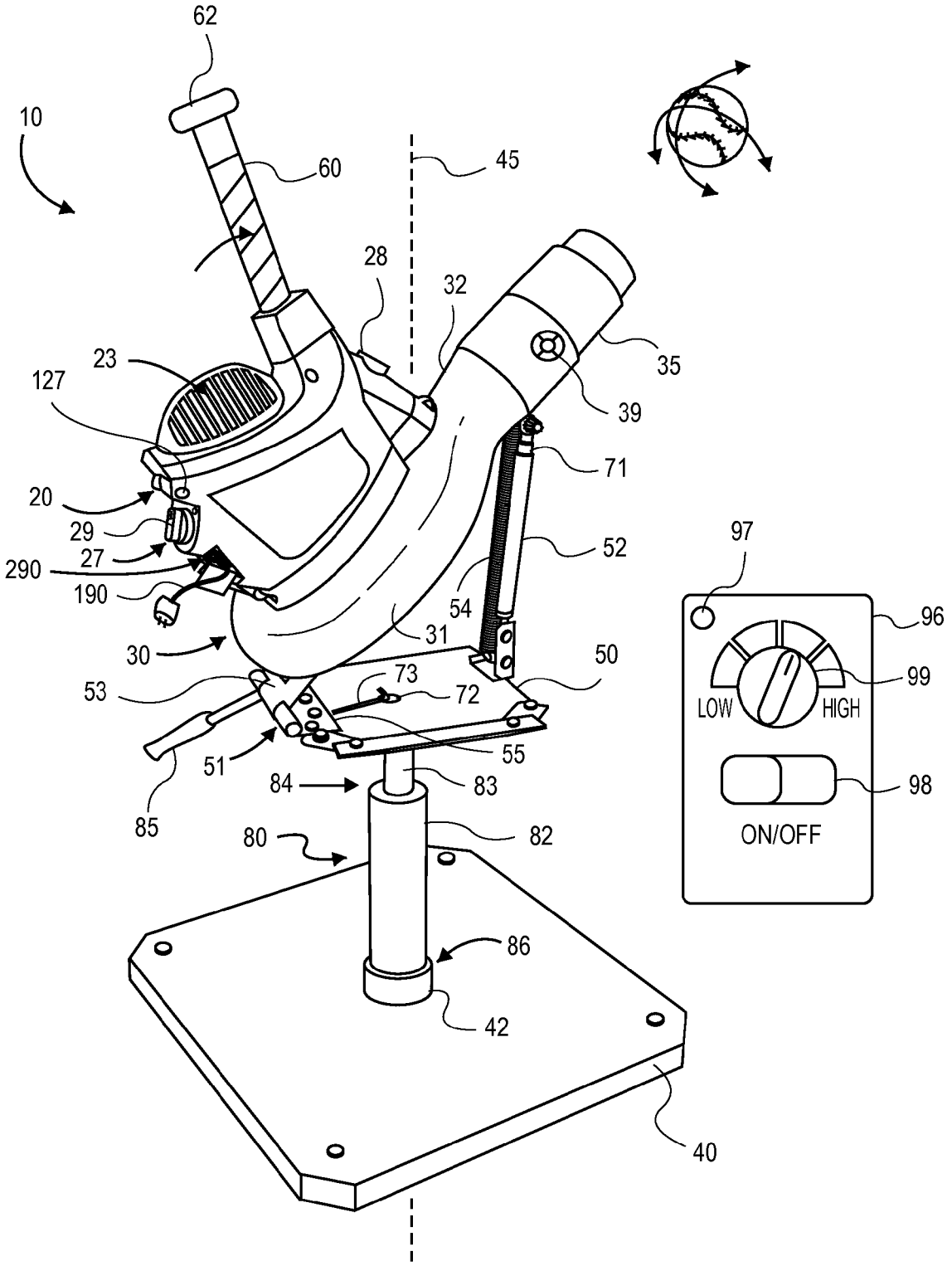
FIG. 11 is a perspective view of an apparatus for suspending and spinning a spherical object in accordance with another example embodiment.

FIG. 11 is a perspective view of an apparatus for suspending and spinning a spherical object in accordance with another example embodiment. As FIG. 11 is similar to FIG. 9, only the differences are discussed in detail.

For the apparatus 10 of FIG. 11, the fan motor 25 is powered by either a first power source including an electrical cord 190 engage able with an electrical outlet, or a second power source including an adapter engage able with a secondary direct current power source, such as a rechargeable battery pack 290. In an example, the first power source includes a retractable line cord, which is retractable within a sub housing enclosure within the motor control unit 20, for example, or in the housing of battery pack 290.

The alternate DC power source may include the battery pack 290 having a voltage of between about 18-36V, in one example about 24V nominal. The secondary DC power source may optionally include a combination power supply and battery charger supplied with at least 115 VAC, which supplies at least 13.6 volts through a diode and a switch to the fan motor 25. A button (not shown) causes the power supply to supply voltage through the diode, and the diode feeds current from the power supply to the fan motor 25. Alternately, a plurality of diodes may act as an automatic steering and isolation network to supply AC supplied current, battery power or simultaneous power and battery charging from AC power.

Therefore, the example method and apparatus for suspending and spinning a spherical object may provide the user an accurate sense and/or feeling of engagement with the suspended object. The significance of an unobstructed path to the object upon engagement there with is desired, in that the user will be able to practice and understand balance, follow through, and the optimum body positioning that may result in more efficient preparation for sport-specific participation.

The example embodiments may be applicable to multiple sports training activities, by providing a moving target adapted to be temporarily stopped or suspended in mid-air for the user's desired engagement. The example apparatus can also be used to promote training in both offensive and defensive simulations and/or techniques. For example, a soccer player may employ the apparatus to suspend a soccer ball to assist a goal keeper in blocking balls kicked or headed toward the goal for defensive simulation training.

The example embodiments being thus described, it will be obvious that the same may be varied in many ways. For example, it has been determined through simulation and that it is possible to utilize apparatus 10 in the dark with spherical objects that are painted with a glow-in-the dark paint. Such an exercise provides another unique training opportunity in a wide variety of athletic-based activities, in one example enabling a batter to better hone their concentration. Such variations are not to be regarded as departure from the example embodiments, and all such modifications as would be obvious to one skilled in the art are intended to be included herein.

What is claimed is:

1. An apparatus for suspending and spinning a spherical object, comprising:

a fixed base, a support plate attached to the base and configured to rotate about a vertical axis through the base, an airflow unit pivotally attached to the support plate at one end thereorf, the other end of the airflow unit terminating in a tubular portion and a hinge having a first bracket part attached to an underside rear end of the airflow unit and a second bracket part attached to a top surface of the support plate on an edge thereof, a piston, and a torsion spring, the piston and torsion spring connected between an underside of the tubular portion and a top surface of the support plate on a side opposite the hinge in side-by-side relation to facilitate movement of the contiguous assembly in a controlled manner back and forth between the first and second angular orientations, a motor control unit removably attached to the airflow unit so as to embody a contiguous assembly, the motor control unit including means for providing variable airflow to the airflow unit, a rotation arm extending from an upper portion of the motor control unit enabling 360 degree rotation of the contiguous assembly via the support plate about the base, and a plurality of interchangeable nozzles configured for attachment to the tubular portion of the airflow unit to direct the airflow generated by the motor control unit for suspending and spinning the spherical object, wherein the apparatus is in a first angular orientation with respect to vertical for loading the spherical object over one of the installed nozzles exhausting air from the airflow unit, and the apparatus is in a second angular orientation with respect to vertical different from the first in order for a user to engage the suspended and spinning spherical object.

2. The apparatus of claim 1, wherein the motor control unit further includes:

a hollow motor housing including a plurality of vents on a surface thereof a latch/release mechanism to removably secure the housing to the upper portion of the airflow unit housing, and a fan motor controller, the blower means further comprising an electric fan motor powering a plurality of rotating blades the fan motor configured to provide variable airflow under control of the fan motor controller so as to rotate the blades to generate air flow into the airflow unit.

3. The apparatus of claim 2, wherein the fan motor is a multi-speed universal motor and the controller is a variable speed motor controller.

4. The apparatus of claim 2, wherein the fan motor is a variable-speed AC or DC motor and the controller is a variable speed motor controller.

5. The apparatus of claim 1, further comprising:

a power source for providing electrical power to the motor control unit.

6. The apparatus of claim 5, wherein the power source is selected from a group comprising AC line cord power and a battery pack.

7. The apparatus of claim 6, wherein the battery pack comprises one or more disposable cells having alkaline or lead-acid cell chemistry.

8. The apparatus of claim 6, wherein the battery pack comprises one or more rechargeable cells having any of a nickel-cadmium (NiCd), nickel-metal-hydride (NiMH), lithium-ion (Li-ion) and lithium phosphate ($Li_2PO_3$) cell chemistry.

9. The apparatus of claim 5, wherein the power source includes AC line cord power and a DC battery pack rechargeable by the AC line cord.

10. The apparatus of claim 1, wherein interior surfaces of the motor control unit and airflow unit are covered with sound dampening material.

11. The apparatus of claim 1 wherein the spherical object is selected from a group comprising a baseball, softball, wiffle ball, tennis ball, volleyball, soccer ball, basketball and golf ball.

12. The apparatus of claim 1, wherein the tubular portion includes a pair of bosses configured to engages openings in each of the interchangeable nozzles for press-fit engagement.

13. The apparatus of claim 1, wherein the piston further includes an adjustable stop thereon to limit piston travel, and the support plate further includes a magnet located thereon for retaining a removable wrench to adjust and tighten the stop on the piston.

14. The apparatus of claim 1, further comprising:

a sleeve attached to an underside of the support plate, a strut having an upper end tension fit into the sleeve and a lower end seated into a holder on the base, and a lever for actuating the strut to adjust height of the support plate so as to raise or lower the assembly thereon.

15. The apparatus of claim 1, wherein the airflow unit further includes:

a hollow housing including the integral tubular portion, a first opening formed in an upper portion of the housing to permit airflow there through from the blower means in the motor control unit to the tubular portion, a second opening formed in a lower portion of the housing, and an air intake screen enclosing the second opening.

16. The apparatus of claim 1, wherein the apparatus is in the first angular orientation with respect to vertical for loading with the nozzle end extending upward in a range of between 0 to 10 degrees from vertical.

17. The apparatus of claim 1, wherein the apparatus is in the second angular orientation with respect to vertical for engaging the suspended and spinning spherical object with the nozzle end extending in a range of between 30 to 50 degrees from vertical.

18. The apparatus of claim 1, wherein the apparatus is in the second angular orientation with respect to vertical for engaging the suspended and spinning spherical object with the nozzle end extending 45 degrees from vertical.

19. An apparatus for suspending and spinning a spherical object, comprising:

a fixed base, a support plate attached to the base, an airflow unit attached to the support plate at one end thereof, the other end of the airflow unit terminating in a tubular portion and a hinge having a first bracket part attached to an underside rear end of the airflow unit and a second bracket part attached to a to surface of the support plate on an edge thereof, a piston, and a torsion spring, the piston and torsion spring connected between an underside of the tubular portion and a top surface of the support plate on a side opposite the hinge in side-by-side relation to facilitate movement of the contiguous assembly in a controlled manner back and forth between the first and second angular orientations, a variable-speed motor, a motor controller adapted to provide speed control for the motor so as to provide variable airflow through the airflow unit, a nozzle attached to the tubular portion of the airflow unit, the apparatus being configured in a first angular orientation with respect to vertical for loading the spherical over the nozzle exhausting air from the airflow unit with the nozzle end extending upward in a range of 0 to 10 degrees from vertical, and the apparatus being configured in a second angular orientation with respect to vertical different from the first in order for a user to engage a suspended and spinning spherical object with the nozzle end extending 30 to 50 degrees from vertical.

20. A method for suspending and spinning a spherical object utilizing the device of claim 1 or claim 19, comprising:

providing a blower operably connected to a power source for creating a variable airflow of forced air, providing an airflow unit coupled to the blower so as to form a contiguous assembly, the airflow unit having in integrally formed tubular portion for directing airflow through a nozzle to suspend and spin the spherical object, placing the assembly in a first angular orientation with respect to vertical for loading the spherical object over the nozzle, and adjusting the assembly to a second angular orientation with respect to vertical different from the first orientation for enabling a user to engage the suspended and spinning spherical object.

21. The method of claim 20, wherein placing the assembly in the first angular orientation further includes orienting the nozzle end upward in a range of between 0 to 10 degrees from vertical.

22. The method of claim 20, wherein placing the assembly in the second angular orientation further includes orienting the nozzle end in a range of between 30 to 50 degrees from vertical.

* * * * *